United States Patent [19]

Cummer

[11] 4,396,000

[45] Aug. 2, 1983

[54] STOVE

[76] Inventor: Lloyd W. Cummer, 630 Dieppe Rd., Winnipeg, Manitoba, Canada, R3R 1C7

[21] Appl. No.: 284,223

[22] Filed: Jul. 17, 1981

Related U.S. Application Data

[63] Continuation of Ser. No. 90,459, Nov. 1, 1979, abandoned.

[30] Foreign Application Priority Data

Dec. 28, 1978 [CA] Canada ..... 318705

[51] Int. Cl.[3] ..... F24C 15/28

[52] U.S. Cl. ..... 126/79; 126/69; 126/77; 126/83

[58] Field of Search ..... 126/58, 60, 65, 79, 126/67, 69, 70, 74, 75, 76, 193, 77, 83

[56] References Cited

U.S. PATENT DOCUMENTS

| | | | |
|---|---|---|---|
| 2,503 | 3/1842 | Mott . | |
| 2,851 | 11/1842 | Phillips . | |
| 115,831 | 6/1871 | Duncan . | |
| 263,498 | 8/1882 | Flannery . | |
| 286,248 | 10/1883 | Allen . | |
| 628,342 | 7/1899 | Mealey . | |
| 689,755 | 12/1901 | Schumann . | |
| 876,909 | 1/1908 | Oblinger . | |
| 1,280,235 | 10/1918 | Kermode . | |
| 1,416,140 | 5/1922 | Thomasson . | |
| 1,669,267 | 5/1928 | Strzelecki . | |
| 4,154,212 | 7/1979 | Wilkinson | 126/77 |
| 4,186,718 | 2/1980 | Goodwin | 126/67 |
| 4,196,713 | 4/1980 | Blackenship et al. | 126/83 |
| 4,201,185 | 5/1980 | Black | 126/83 |
| 4,201,186 | 5/1980 | Paquin | 126/83 |
| 4,207,861 | 6/1980 | Buckner | 126/193 |
| 4,320,737 | 3/1982 | Wolf | 126/58 |
| 4,320,738 | 3/1982 | Johnson | 126/69 |
| 4,347,831 | 9/1982 | Graziano | 126/83 |

FOREIGN PATENT DOCUMENTS

| | | |
|---|---|---|
| 7947 | 8/1877 | Canada . |
| 31290 | 4/1889 | Canada . |
| 31641 | 5/1889 | Canada . |
| 47719 | 11/1894 | Canada . |
| 606510 | 10/1960 | Canada . |
| 36143 | 1/1930 | France . |

*Primary Examiner*—Daniel J. O'Connor

*Attorney, Agent, or Firm*—Burge, David A.

[57] ABSTRACT

A solid fuel-burning stove has a fire chamber defined by its walls and top and an upper gas recirculating chamber with a convex portion is provided in the top section of the stove.

3 Claims, 3 Drawing Figures

STOVE

This is a continuation of application Ser. No. 90,459, filed Nov. 1, 1979, now abandoned.

This invention relates to stoves and in particular to a stove of the solid fuel burning variety.

The popularity of stoves that burn solid fuels suchas wood is on the increase in view of the shortage of world oil. The return to an interest with wood burning stoves has also been accompanied by the renewed interest in increasing the efficiency of such stoves.

The stove of the present invention incorporates a gas recirculating chamber within the top portion of the stove to effect further burning of gases coming from the fire before the gases exit the stove by the chimney.

In a broad aspect, the present invention relates to a stove for burning solid fuels comprising side walls, front and rear walls and a top defining a fire chamber; and a chimney from said first chamber; the top of said stove having a convex portion adapted to effect recirculation of gases for further burning before said gases exit said chamber through said chimney.

The invention is illustrated by way of example in the accompanying drawings in which.

Figure 2:
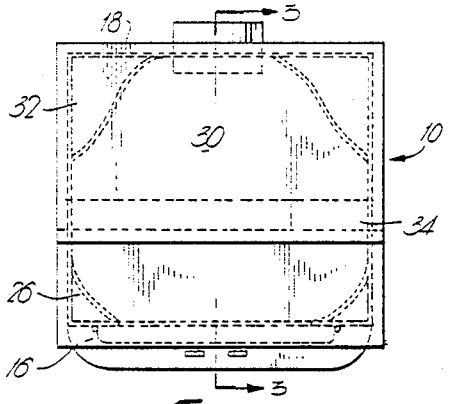
FIG. 2 is a top view of the stove shown in FIG. 1.
Figure 1:
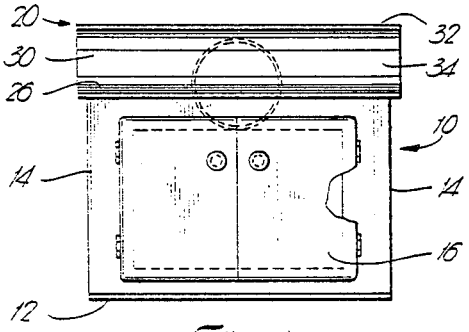
FIG. 1 is a front elevation of a stove incorporating the present invention.

Referring to the drawings, the stove 10 has a bottom wall 12, side walls 14, front and back walls 16 and 18 and a top portion generally indicated at 20. The general construction of the stove is preferably that of high grade quarter inch steel plating and if necessary, a layer of 1¼ inch fire brick may be included on the walls to resist warpage of the stove after prolonged use. The front wall 14 includes a pair of doors 16 for entrance to the fire chamber 22. The doors may be lined with asbestos or some other suitable insulating material to assure a substantial air tight fit to provide fuel conservation and prolonged heat from each load of wood. A damper not shown, can be provided on each door. The back wall 18 of the stove has a standard exhaust pipe 24 for connection to a common chimney, not shown.

Figure 3:
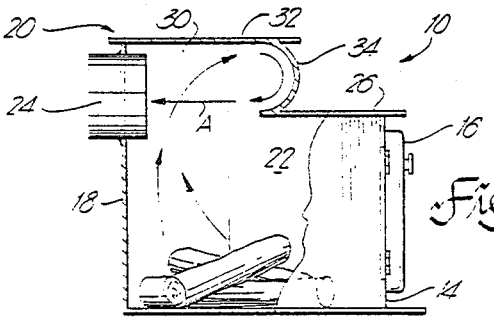
FIG. 3 is a sectional view taken along the lines 3—3 of FIG. 2.

The top portion 20 of the stove has a normal top surface 26 and in addition is provided with an upper gas recircuiting chamber 30 comprising a flat upper surface 32 which is parallel with the top portion 26 and interconnected thereto by means of an elongated, curved convex member 34 shown in cross-section in FIG. 3.

As indicated by the arrows A in FIG. 3, the curvature of the member 34 and the recirculating chamber 30 provides a means for recycling or recirculating the gases arising from the fire in the chamber 22 to provide extra burning for such gases before they pass through the exhaust pipe 24 into the chimney. The effect of the recirculation and extra burning of the gases is to provide a longer burning and heating process from the fuel in the fire chamber 22 thereby saving in heat costs and reduced ash disposal.

I claim:

1. A stove for burning solid fuels such as wood, said stove comprising side walls, a top wall, a rear wall and a front wall with at least one door thereon, said walls collectively defining a substantially air tight fire chamber, damper means controlling air flow to said fire chamber, and a substantially unobstructed gas recirculation chamber above said top wall of the stove in open communication with said first chamber therebeneath and extending substantially the width thereof;

said recirculation chamber including a top wall parallel with and vertically spaced above the top wall of said stove, and a front wall interconnecting said two top walls, a laterally directed exhaust pipe in the rear wall of said recirculation chamber for connecting said stove to a chimney, said front wall of the recirculation chamber being spaced a substantial distance rearwardly from the front wall of the stove and having a configuration effecting intermingling and further circulation of gases rising from said fire chamber for additional burning to maximize heat output before said gases pass to said exhaust pipe and thereby providing minimum residual ash for disposal, wherein said reciruclation chamber front wall is of convex cross section and transversely disposed forwardly of said exhaust pipe with the concave inner face thereof facing said recirculation chamber in laterally spaced relation thereto to permit swirling motion of recirculating gases between said concave face and said exhaust pipe without tortuous flow thereof while the convex outer face provides enhanced surface area for heat radiation.

2. The stove of claim 1 wherein said damper means are provided in said door.

3. The stove of claims 1 or 2 wherein said door is lined with insulating material to enhance the seal thereof in providing said substantially air tight fire chamber.

* * * * *